United States Patent [19]

McKelvey

[11] 3,932,054

[45] Jan. 13, 1976

[54] VARIABLE PITCH AXIAL FAN

[75] Inventor: Wilfred G. McKelvey, Palos Verdes, Calif.

[73] Assignee: Western Engineering & Mfg. Co., Marina del Rey, Calif.

[22] Filed: July 17, 1974

[21] Appl. No.: 489,077

[52] U.S. Cl. ..... 415/130; 415/140

[51] Int. Cl.[2] ..... F01D 7/00

[58] Field of Search ..... 416/164, 168, 169; 415/129, 130, 149

[56] References Cited

UNITED STATES PATENTS

| | | | |
|---|---|---|---|
| 2,390,068 | 12/1945 | Adams, Jr. et al. | 415/129 |
| 2,495,433 | 1/1950 | Troller | 416/164 |
| 2,664,961 | 1/1954 | Goede | 415/129 |
| 2,665,054 | 1/1954 | Fischer | 416/168 |
| 2,981,463 | 3/1961 | Dagrell | 415/129 |
| 3,397,836 | 8/1968 | Badger et al. | 415/150 |

FOREIGN PATENTS OR APPLICATIONS

| | | | |
|---|---|---|---|
| 249,512 | 8/1960 | Australia | 415/129 |
| 7,470 | 11/1956 | Germany | 416/168 |

*Primary Examiner*—Henry F. Raduazo

*Attorney, Agent, or Firm*—Fulwider Patton Rieber Lee & Utecht

[57] ABSTRACT

An axial fan operative to control the developed air volume and pressure by varying the pitch of the fan blades. The fan housing is adapted to be connected to the main air conduit as an axial continuation thereof and centrally mounts a fan motor which directly drives the fan. The blade pitch control mechanism adjacent the fan utilizes an axially reciprocable actuator coupled through linkages to each of the fan blades whereby the pitch of all of the blades is simultaneously changed upon movement of the actuator. The control mechanism is contained within the fan hub and within a cylindrical central fairing located adjacent the fan and radially inwardly of the blades. This protects the control mechanism and reduces drag. The actuator is moved axially by means located externally of the main air conduit and connected to the actuator by a single lever arm extending through the central fairing and main air conduit.

3 Claims, 4 Drawing Figures

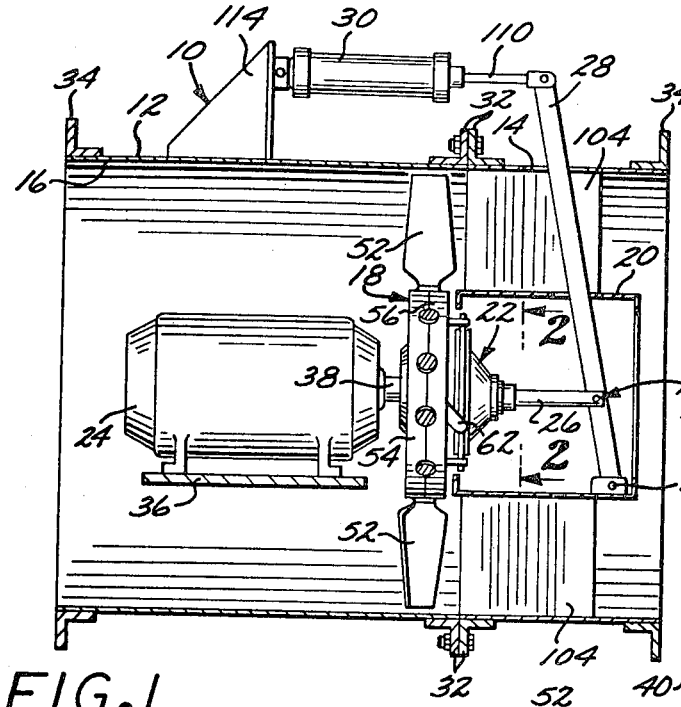
FIG. 1
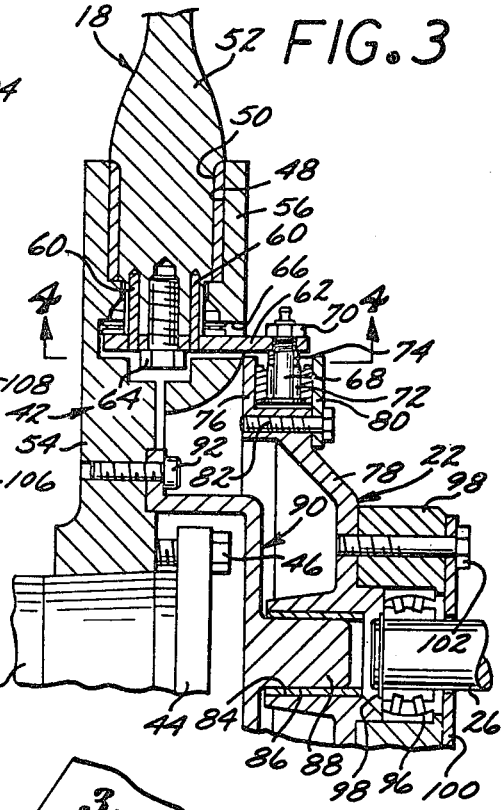
FIG. 3
FIG. 2
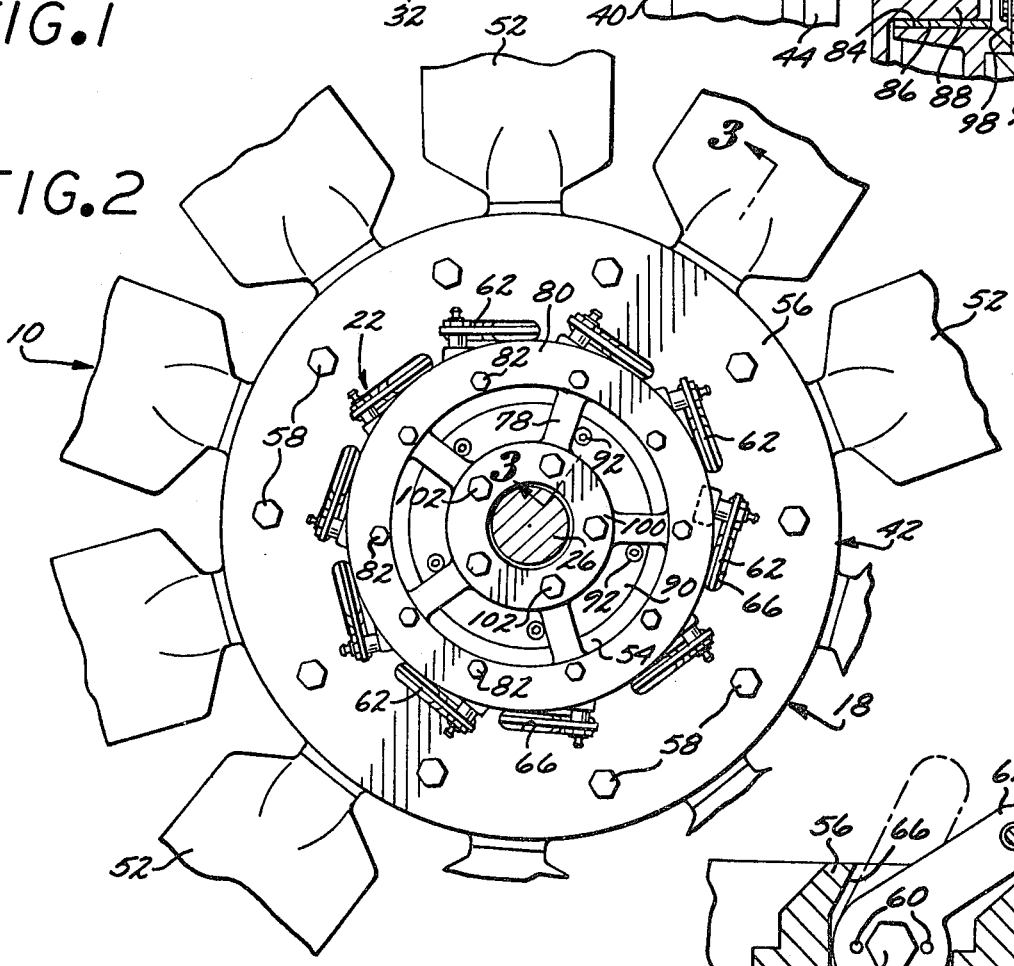
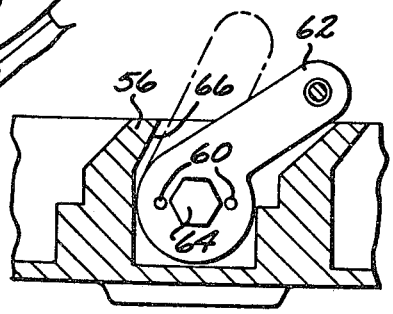
FIG. 4

VARIABLE PITCH AXIAL FAN

BACKGROUND OF THE INVENTION

1. Field of the Invention

The present invention relates to an axial fan having variable pitch fan blades for controlling the air volume or pressure developed.

2. Description of the Prior Art

In large air conditioning installations for multistory buildings and the like the demands or loads upon the air conditioning system constantly vary as portions of the building are temporarily put out of service, as weather conditions change, etc. These load changes are sensed in various ways, such as by detecting changes in the volume of air passing through the air conditioning fan, or by detecting pressure changes in the main air conduit. Regardless of the sensing means, the load changes sensed must be quickly and automatically compensated for by changing the output of the air conditioning fan.

One method of the prior art effects compensating adjustments by using inlet vane dampers, but this has proved to be noisy and wasteful of power. Another method adjusts the fan output by automatically varying the pitch of the fan blades, but most of the fans utilizing this approach have been unduly expensive, complex, difficult to maintain, and characterized by wasteful internal drag.

SUMMARY OF THE INVENTION

According to the present invention, an axial fan is provided having variable pitch blades controlled by a variable pitch mechanism enclosed essentially completely within the fan hub and within a central fairing located adjacent the fan hub and radially inwardly of the blades. The blades sweep through an annular space defining the main air flow path. The fan motor, fan hub, and central fairing are axially aligned in the relatively low velocity central portion of the means defining the air flow path. This greatly reduces drag and simplifies interconnections between the fan components.

The variable pitch mechanism is operative upon the inner ends of the blades to pivot them simultaneously and according to the axial position of an actuator located within the previously mentioned central fairing. The actuator is sensitively responsive to the piston movement of an externally located control cylinder, a single lever arm connecting the two and multiplying the piston travel several times. This single lever arm is essentially the only control element extending from the centrally located variable pitch mechanism to the exterior, through the intervening relatively high velocity, annular air flow path. Consequently, the fan of the present invention provides a relatively straight-forward, low maintenance, low drag, and sensitive means for varying fan blade pitch continuously and as operational conditions dictate.

Other objects and features of the invention will become apparent from consideration of the following description taken in connection with the accompanying drawings.

BRIEF DESCRIPTION OF THE DRAWINGS

FIG. 1 is a longitudinal cross-sectional view of a variable pitch, axial fan according to the present invention, illustrated in association with usual outlet guide vanes;

FIG. 2 is an enlarged view taken along the lines 2—2 of FIG. 1;

FIG. 3 is a view taken along the lines 3—3 of FIG. 2; and

FIG. 4 is a view taken along the lines 4—4 of FIG. 3.

DESCRIPTION OF THE PREFERRED EMBODIMENT

Referring now to the drawings, there is illustrated a variable pitch axial fan apparatus 10 according to the present invention and comprising, generally, housing means which include a fan housing 12 and a vane housing 14. The inner walls of these housings define a cylindrical air conduit 16 within which is centrally mounted an axial fan 18 and an adjacent central fairing 20. The apparatus 10 also includes blade pitch control mechanism 22; a fan drive means or motor 24; an actuator shaft 26 for actuating portions of the blade control mechanism 22; an operating lever 28 coupled to the actuator shaft 26; and an operating means located externally of the conduit 16 and including an air cylinder 30 actuable to operate the lever 28, as will be seen.

Fan housings 12 and 14 are cylindrical in configuration and are provided with complemental circumferential flanges 32 secured together by suitable fasteners to define the axially continuous air conduit 16 through the housings. The opposite ends of the housings 12 and 14 include similar circumferential flanges 34 which enable the housings to be connected to complemental flanges (not shown) on the main air conduit of the air conditioning system with which the apparatus 10 is to be used. This allows the apparatus 10 to be quickly and easily installed in existing air conditioning systems by merely interposing the apparatus 10 between spaced apart flanged ends of the air conditioning system conduit. The apparatus 10 is then operative to draw air through the air conduit 16 from left to right, as viewed in FIG. 1.

The fan drive means or motor 24 is an electric motor adapted to handle the fan load requirements. It is conveniently mounted on a transversely extending, horizontal platform 36 attached at its opposite sides to the adjacent walls of the conduit 16, as best seen in FIG. 1.

The fan motor drive shaft 38 is fixedly received within the central opening of a conventional taper lock bushing 40, FIG. 3, mounted to a hub 42 of the fan 18 by a circular plate 44. The plate 44 is held in position by a plurality of bolts 46 threaded into suitable openings (not shown) provided in the hub 42 adjacent the bushing 40. Thus, operation of the fan motor 24 is effective to rotate the hub 42 of the fan 18 about the longitudinal axis of the conduit 16.

As best seen in FIGS. 2–4, the fan hub 42 is generally circular and includes a plurality of circumferentially spaced blade openings 48 which each receive a sleeve bearing 50 made of bronze or the like to rotatably support the cylindrical inner portion of a radially extending fan blade 52. Use of the sleeve bearing 50 is an important feature in that it provides a substantial bearing area along the axial length of the inner portion of the fan blade 52. This provides blade stability, and reduces vibration and metal fatigue.

The fan hub 42 occupies the central portion of the air conduit 16 so that the fan blades 52 sweep through an annular space defined by the hub periphery and the adjacent inner wall of the air conduit 16. This annular space constitutes the main air flow path for air drawn through the conduit 16.

As best viewed in FIGS. 1 and 3, the hub 42 includes two sections which together form the openings 48 within which the fan blades 52 are received. There is a larger main section 54 and an annular second section 56 attached to the section 54 by a plurality of bolts 58. The roots or inner extremities of the fan blades 52 are received within reduced-diameter openings formed in the hub sections 54 and 56 adjacent the openings 48. Short linkage arms 62 are provided for the blades 52, respectively, to effect simultaneous pitch change of the blades 52.

The inner end of each arm 62 includes an opening to receive the reduced diameter end of an associated blade 52, as best viewed in FIG. 3, with the linkage arm 62 being constrained against rotation relative to the blade 52 by means of a pair of pins 60, as seen in FIG. 4. The pins 60 are disposed through aligned openings in the arm 62 and the associated blade 52, and each arm 62 is secured in the pinned position by a headed bolt 64 which extends through the arm 62 and into the blade 52.

The hub section 56 includes a plurality of slots 66 through which the linkage arms 62 extend. The outer end of each arm 62 includes an opening which receives the threaded end of a stub shaft 68, and a nut 70 is used to secure the shaft 68 to the arm 62. The other end of each stub shaft 68 is rotatable within a bearing 72 spaced from the arm 62 by a sleeve spacer 74.

The bearings 72 rest upon an annular, circumferentially extending edge portion 76 of an actuator 78 and are held in position by an annular ring 80 arranged in opposed relation to the edge portion 76 and defining a circumferentially extending space forming seats for the bearings 72. The ring 80 is secured in clamping relation to the bearings 72 by a plurality of bolts 82 which are threaded through the ring 80 and into adjacent portions of the actuator 78. With this arrangement all of the linkage arms 62 are moved simultaneously, upon axial movement of the actuator 78, to simultaneously rotate and thereby change the pitch of the associated blades 52.

The actuator 78 is generally circular with its central axis aligned with the axis of the motor drive shaft 38 and fan 18. A central opening 84 in the actuator 78 mounts a sleeve bearing 86 which is fitted over a central cylindrical portion 88 of a guide 90 to enable relative slidable axial movement therebetween. The guide 90 is located adjacent the hub section 54 and is secured to it by a plurality of bolts 92. Thus, the guide 90 acts to confine movement of the actuator 78 to the central axis of fan 18.

The actuator 78 is moved axially by an elongated actuator shaft 26. The inner end of the shaft 26 is received within a spherical roller bearing 96 and is held in the bearing by a retaining ring 98. The outer race of the bearing 96 is carried within a bearing housing 98 and is retained therein by a cover 100, both the cover 100 and the housing 98 being secured to the actuator 78 by a plurality of bolts 102.

The actuator 78 and linkage arms 62 constitute portions of the blade pitch control mechanism 22 and, as best seen in FIG. 1, these and their associated components are completely enclosed within the cylindrical central fairing 20. The actuator shaft 26 and a portion of the operating lever 28 are similarly enclosed. Moreover, the fairing 20, fan hub 42, and motor 24 are all located inwardly of the annular space through which passes the high velocity air stream developed by the rotating fan blades 52. Consequently, internal drag losses are minimized in the present apparatus, and this in turn results in lower power consumption and greater efficiency.

The fairing 20 is supported by attachment to the inner extremities of a plurality of conventional circumferentially arranged, radially extending guide vanes 104 whose outer extremities are attached to the vane housing 14.

Axial movement of the operating shaft 26 by the operating lever 28 simultaneously changes the pitch of all of the blades 52. To accomplish this the inner end of the lever 28 is secured to the central fairing 20 for pivotal movement about a pin 106. Such pivotal movement is imparted to the actuator shaft 26 by pivotal attachment of the lever 28 to the shaft 26 by means of a pin 108. The outer extremity of the lever 28 extends upwardly through slots provided in the fairing 20 and in the vane housing 14. Its outer end is pivotally secured to the outer end of a piston rod 110 which forms part of the air cylinder 30 which is supported upon the fan housing 12 by a support bracket 114.

In operation, the fan apparatus 10 is installed in the air conditioning system as previously described, suitable electrical connections (not shown) being made to the fan motor 24 for energization thereof and rotation of the fan 18, as will be apparent. The air cylinder 30 forms a part of usual and conventional sensing and operating or control apparatus operative to sense changes in air pressure or volume and made appropriate corrections; as will be apparent to those skilled in the art. In general, such a system compares the sensed condition with the desired condition, and generates an error signal. This error signal initiates a change in the air pressure applied to the air cylinder 30 so that the piston rod 110 changes its position accordingly, and there is corresponding pivotal movement of the operating lever 28 and generally axial movement of the actuator shaft 26. The piston rod 110 is normally biased inwardly by springs or the like (not shown).

The pivotal connection of shaft 26 to the lever 28 results in a slight pivotal action of the shaft 26, but this is accommodated by the action of the spherical roller bearing 96. The bearing 96 also allows relative rotation between the nonrotatable shaft 26 and the rotating fan hub 42, guide 90, actuator 78, and bearing housing 98.

As the actuator shaft 26 moves axially, there is a corresponding slidable movement of the actuator 78 upon the guide 90 which causes the linkage arms 62 to pivot together and thereby change the pitch of all of the fan blades 52 simultaneously.

The present fan apparatus 10 thus provides an inexpensive and relatively straight-forward means for adjusting the output of the fan 18 by adjusting the pitch of the fan blades 52 through the use of a blade control mechanism 22 and associated components essentially completely enclosed in the central fairing 20 and in the fan hub 42. Further, such components are located in the relatively low velocity central portion of the air conduit 16, with only the fan blades 52 being located in the annular, relatively high velocity air flow region of the conduit 16. It is of particular interest that the pivots 106 and 108 are enclosed in the fairing 20, where they are protected from dirt, dust and the like in the airstream. This prolongs service life of the unit without maintenance. Consequently, drag and noise in the system is quite low, and efficiency is relatively high. Also, other than the electrical connection to the fan motor 24, the only externally extending element is the operating lever 28, which further reduces drag in the system.

Various modifications and changes may be made with regard to the foregoing detailed description without departing from the spirit of the invention.

I claim:

1. A variable pitch axial fan apparatus comprising: housing means having an inner wall defining a cylindrical air conduit;

a fan centrally mounted in said air conduit for rotation about the axis of said conduit, said fan including a hub, a plurality of elongated blades radially extending from and carried at their roots by said hub for pivotal movement about their axes, respectively, to vary the pitch of said blades, said hub including a plurality of openings adjacent the roots of said blades, respectively;

a cylindrical central fairing located in said air conduit and including an actuator coaxial with and carried by said hub for axial movement, a plurality of linkages extending between said actuator and said blades, said actuator including means defining circumferentially arranged seats adjacent said plurality of openings, and a plurality of elements pivotally carried in said seats, respectively, and said linkages including arms coupled to said blades, extending through said openings, and coupled to said elements, respectively, whereby said blades are pivoted upon said axial movement of said actuator;

fan drive means coupled to said fan for rotation thereof;

an actuator shaft extending axially of said actuator and axially movable to effect said axial movement of said actuator;

an operating lever extending generally transversely of said actuator shaft and externally of said air conduit; and operating means located externally of said air conduit and actuable to pivot said operating lever to axially move said actuator shaft.

2. A variable pitch axial fan apparatus according to claim 1 wherein said fan drive means comprises a motor located within said air conduit in axial alignment with said hub, and including means supporting said motor and connected to said inner wall of said housing means.

3. A variable pitch axial fan apparatus according to claim 1 and including sleeve bearings in said fan hub for pivotally supporting said blades on said hub, respectively, each of said sleeve bearings constituting a single long sleeve extending axially of the inner portion of the associated one of said blades and bearing radial loads whereby blade stability is promoted and blade vibration is reduced.

* * * * *